US005339006A

United States Patent [19]

Schellen

[11] Patent Number: 5,339,006

[45] Date of Patent: Aug. 16, 1994

[54] HIGH PRESSURE DISCHARGE LAMP

[75] Inventor: Johannes A. T. Schellen, Eindhoven, Netherlands

[73] Assignee: U.S. Philips Corporation, New York, N.Y.

[21] Appl. No.: 25,451

[22] Filed: Mar. 2, 1993

[30] Foreign Application Priority Data

Mar. 13, 1992 [EP] European Pat. Off. ..... 92200731.5

[51] Int. Cl.[5] ..... H01J 19/78

[52] U.S. Cl. ..... 315/58; 315/46

[58] Field of Search ..... 315/46, 53, 58, 59, 315/73

[56] References Cited

U.S. PATENT DOCUMENTS

| | | | |
|---|---|---|---|
| 4,173,730 | 11/1979 | Young et al. | 315/53 |
| 4,383,200 | 5/1983 | Van Zon et al. | 315/58 |
| 4,547,704 | 10/1985 | Brinn et al. | 315/71 |
| 4,897,576 | 1/1990 | Iida et al. | 315/73 |
| 4,902,933 | 2/1990 | Roberts | 315/71 |
| 5,039,908 | 8/1991 | Bouchard | 315/73 |
| 5,045,757 | 9/1991 | Takenobu et al. | 315/73 |
| 5,053,676 | 10/1991 | Luijks et al. | 315/58 |
| 5,185,557 | 2/1993 | Luijks et al. | 315/53 |
| 5,187,416 | 2/1993 | Bazin | 315/73 |

*Primary Examiner*—John T. Kwon

*Attorney, Agent, or Firm*—Brian J. Wieghaus

[57] ABSTRACT

The invention relates to a high-pressure discharge lamp provided with a discharge vessel which is enclosed with intervening space by an outer bulb fitted with a lamp cap. The lamp is provided with an ignition circuit in which a fuse is included, which is placed in an oxidizing atmosphere.

19 Claims, 1 Drawing Sheet

HIGH PRESSURE DISCHARGE LAMP

BACKGROUND OF THE INVENTION

The invention relates to a high-pressure discharge lamp provided with a discharge vessel which is enclosed with intervening space by an outer bulb fitted with a lamp cap, and provided with an ignition circuit in which a fuse is included, which discharge vessel is provided with electrodes between which a discharge extends in the operational condition of the lamp, each electrode being connected to a relevant current supply conductor.

A lamp of the kind mentioned in the opening paragraph is known from EP-A-431,696 which corresponds to U.S. Pat. No. 5,055,676. In the known lamp, the ignition circuit is suitable for being operated in series with a stabilizer ballast on an AC-voltage supply source and is arranged in the outer bulb. The known lamp is a high-pressure sodium lamp which is suitable for operation in an installation designed for a high-pressure mercury discharge lamp. The relevant stabilizer ballast is in general not protected against loads in the form of short-circuit currents through the lamp, more particularly through its ignition circuit. This is why a fuse is included in the ignition circuit, which fuse melts in the case of a short-circuit in the ignition circuit, thus protecting the stabilizer ballast against excessively high currents.

The fuse is positioned in vacuum. Preferably, the space enclosed by the outer bulb is evacuated because this is favourable for the luminous efficacy of the lamp.

It was found in practice that melting of the fuse in the known lamp, which depends primarily on the diameter of the wire from which the fuse is manufactured, requires a comparatively high current, and also that the time during which this current is carried before actual melting takes place varies very strongly. Especially the spread in fusion time is a serious drawback, since it detracts strongly from the reliability of the fuse.

SUMMARY OF THE INVENTION

The invention has for its object inter alia to provide a measure by which the reliability of the fuse can be considerably improved.

According to the invention, this object is achieved in that the lamp of the kind mentioned in the opening paragraph is characterized in that the fuse is placed in an oxidizing atmosphere. By positioning the fuse in an oxidizing atmosphere, it is found to be possible to realise the fuse in such a manner that it melts at a comparatively low current strength and in a comparatively short time, whereby the spread in fusion time is largely eliminated. This implies a considerable improvement in the reliability of the fuse and thus an improvement in the quality of the lamp.

Preferably, the fuse is mounted in a gastight, for example glass capsule. This offers the advantage that the fuse is enclosed in a housing by means of a technique which has long been known and proved appropriate, so that manufacture is simple and reliable. For the oxidizing atmosphere a mixture of $N_2$ and $O_2$ is most suitable because of the substantially unlimited availability. Other suitable gases and gas mixture, are for example, pure $O_2$; a mixture of $O_2$ and $Sf_6$; and a mixture of $O_2$ and rare gas.

If the ignition circuit comprises a voltage-dependent capacitor, the latter is preferably mounted in the gastight capsule together with the fuse, in which case it is possible for the voltage-dependent capacitor and the fuse to be integrated into a single component. If the fuse is constructed as a separate element in the form of a wire, it can also act as a flexible mounting means for the voltage-dependent capacitor, which is favourable inter alia for the level of the voltage pulse to be generated by the capacitor. The operational life of the capacitor is also favourably influenced by this.

A further improvement of the lamp can be achieved in that the gastight glass capsule is provided with a radiation-reflecting layer. This achieves in a simple but effective manner that heating of the capacitor in the operational condition of the lamp is considerably limited. The radiation-reflecting layer may be provided externally or internally. Preferably, the voltage-dependent capacitor is so positioned that the longitudinal axis of the discharge vessel lies substantially in one common plane with the capacitor, which usually has a disc shape. Irradiation of the capacitor is minimized by this.

The lamp according to the invention is in particular suitable as a replacement for a high-pressure mercury lamp. To improve the ignition characteristics of the lamp, the discharge vessel may be provided with an external ignition antenna which rests substantially against the discharge vessel at least in the non-operational condition of the lamp.

The ignition circuit of the lamp according to the invention may also comprise a voltage-dependent breakdown element such as, for example, a SIDAC.

BRIEF DESCRIPTION OF THE DRAWINGS

This and other aspects of the invention will be explained in more detail and described with reference to a drawing of an embodiment in which.

DESCRIPTION OF THE PREFERRED EMBODIMENTS

Figure 1:
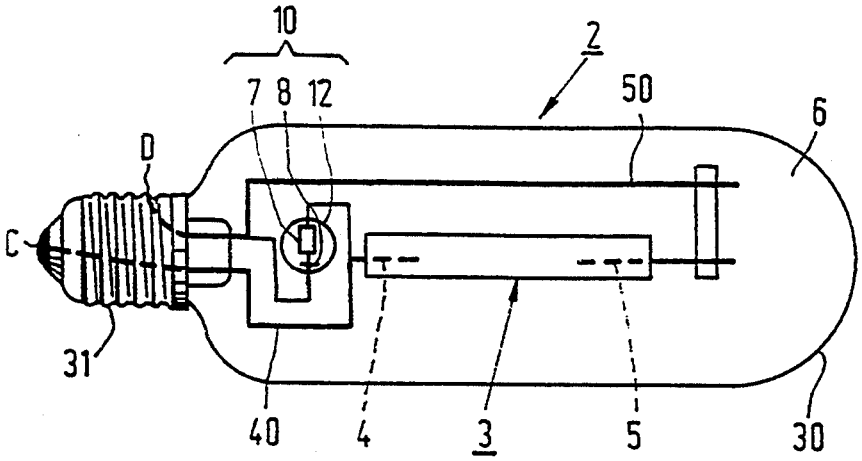
FIG. 1 is an elevation of a lamp.

In FIG. 1, a lamp 2 according to the invention is shown provided with a discharge vessel 3 which is enclosed with an intervening evacuated space 6 by an outer bulb 30 fitted with a lamp cap 31, and provided with an ignition circuit 10 in which a voltage-dependent capacitor 8 and a fuse 7 are included. The fuse 7 together with the voltage-dependent capacitor 8 is mounted in a gastight glass capsule in the evacuated space 6 enclosed by the outer bulb 30. The discharged vessel 3 is provided with electrodes 4 and 5 between which a discharge extends in the operational condition of the lamp. Each electrode 4, 5 is connected to a relevant rigid current supply conductor 40, 50. Current supply conductor 40 is connected to a lamp connection point C of lamp cap 31. Similarly, current supply conductor 50 is connected to a lamp connection point D of lamp cap 31. The gastight glass capsule 12 comprising the ignition circuit 10 is mounted between the current supply conductors 40 and 50. The gastight glass capsule is filled with an oxidizing atmosphere consisting of a mixture of $N_2$ and $O_2$ with a pressure of 500 mbar at room temperature.

Figure 2:
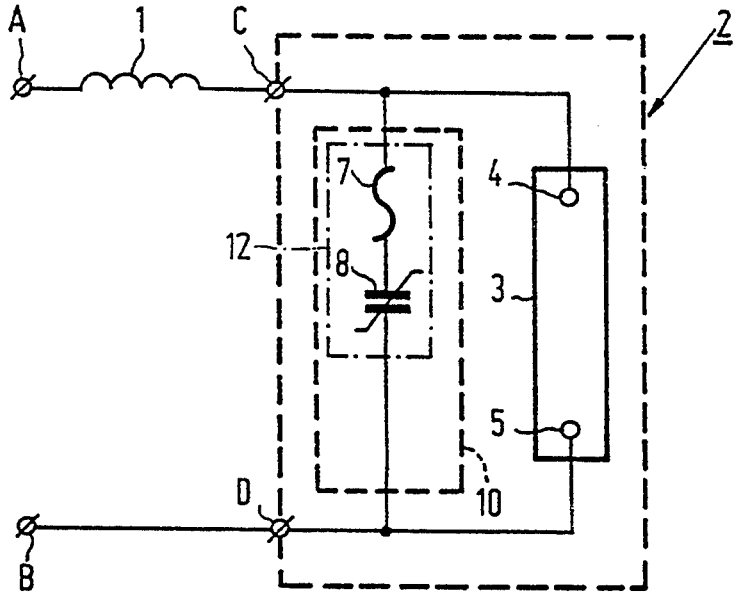
FIG. 2 is a diagram of a circuit formed by the lamp of FIG. 1 together with a stabilizer ballast.

In FIG. 2, parts corresponding to those in FIG. 1 are given the same reference numerals. A and B are connection terminals for connecting an AC-voltage supply source. Terminal A is connected to lamp connection point C via a stabilizer ballast 1. Terminal B is connected to lamp connection point D. The ignition circuit 10 formed by the fuse 7 and the voltage-dependent capacitor 8 together with the stabilizer ballast 1 generates ignition voltage pulses between the lamp connection points C and D, and thus between the lamp electrodes 4 and 5, in known manner.

The discharge vessel 3 may be provided with an external auxiliary electrode as a further ignition aid.

A practical embodiment of a lamp according to the invention is a high-pressure sodium discharge lamp with a power rating of 110 W and an evacuated outer bulb. The lamp may be operated via a stabilizer ballast, type BHL125L, make Philips, on a 220 V, 50 Hz supply voltage source. The discharge vessel is preferably provided with an external auxiliary electrode. The fuse 7 consists of a tungsten wire with a diameter which is so chosen that, when exposed to air, it will melt in approximately 8 seconds at a current of 0.5 A. The voltage-dependent capacitor, make TDK, has a constant capacitance value of approximately 2 nF above a limit temperature of 90° C. The plate-shaped capacitor has dimensions of 17 mm×9 mm×0.7 mm. The fuse 7 may be integrated with the capacitor 8 into a single component, for example, in that the fuse is provided on an insulating bottom layer at one side of the integral component by means of film technology.

Upon connection to the 220 V, 50 Hz supply source, the ignition circuit thus constructed generates an ignition voltage pulse of approximately 1000 V approximately 1 ms after each zero passage of the supply voltage. The lamp can ignite quickly and reliably on this.

In the operational condition of the lamp, the temperature of the voltage-dependent capacitor will lie between 150° C. and 200° C., so above the limit temperature. The capacitance value is in that case independent of the voltage and is 2 nF, so that the generation of pulses is effectively suppressed.

Fusion times of the fuse 7 were measured for practical embodiments of the lamp described. For comparison, fusion times measured for similar lamps whose fuses were positioned in vacuum were also measured. Results of the measurements are given in the Table below.

TABLE

| Lamps according to the invention | | Lamps with fuse in vacuum | |
|---|---|---|---|
| fusion current | fusion time | fusion current | fusion time |
| 480 mA | 8 s | 850 mA | 8 s |
| 490 mA | 8 s | 850 mA | 58 s |
| 600 mA | 4 s | | |

The results listed in the Table show that the spread in fusion times has practically completely disappeared when the fuse is placed in an oxidizing atmosphere and a fusion current strength occurs for which the fuse was dimensioned. The fusion time is halved in the case of a load current which is 20% higher than the rated fusion current.

For known lamps, on the one hand, the fusion current lies considerably higher than for the comparable fuse positioned in an oxidizing atmosphere, and on the other hand, the fusion time varies very strongly.

Figure 3:
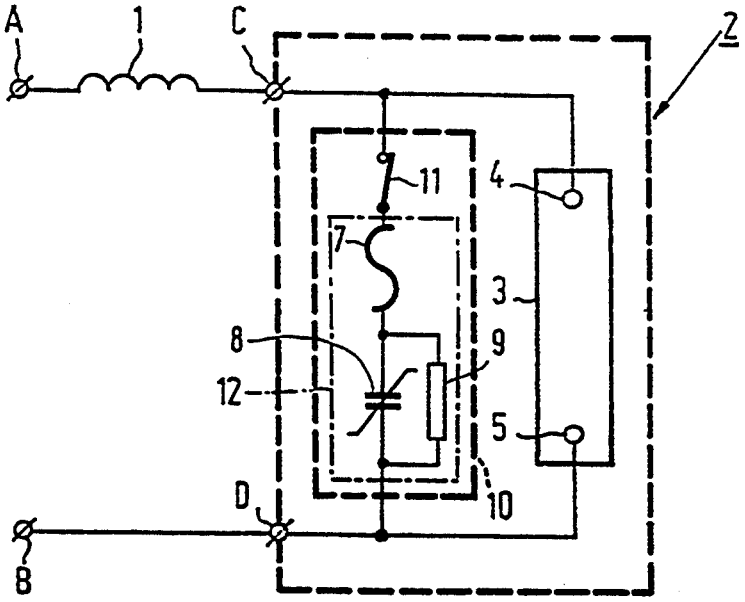
FIG. 3 is a diagram of a circuit formed by the lamp of FIG. 1 provided with a modified version of the ignition system.

In FIG. 3, parts corresponding to those in FIG. 1 are given the same reference numerals. The ignition circuit 10 is in addition provided with a resistor 9 and a bimetal switch 11. A voltage-dependent capacitor 8, a fuse 7, and a high-ohmic resistor 9 are included in the gastight glass capsule 12 in an oxidizing atmosphere of $N_2$ and $O_2$. The circuit comprising bimetal switch 11, fuse 7 and voltage-dependent capacitor 8 of the ignition circuit 10 in conjunction with the stabilizer ballast 1 generates ignition voltage pulses between the lamp connection points C and D, and thus between the lamp electrodes 4 and 5, in known manner. When the lamp has ignited, the bimetal switch 11 will open as a result of heat generation, so that further ignition pulse generation is effectively stopped. Any residual charge at the voltage-dependent capacitor can drain off to terminal B through resistor 9.

The discharge vessel 3 may be provided with an external auxiliary electrode as a further ignition aid.

In a practical lamp of the high-pressure sodium discharge type with a power rating of 110 W and an evacuated outer bulb, the fuse has a fusion current value of 0.5 A and the resistor has a value of 1 MOhm.

A resistor of this value, which can assume a temperature of more than 200° C. in the operational condition of the lamp, is perfectly suitable for being constructed in the form of a ceramic resistor on an insulating base layer manufactured by means of thick-film technology. Preferably, the relevant resistor is integrated into a single component together with the fuse and a voltage-dependent capacitor, make TDK, for example, of the NLB 1250 type.

Ignition voltage pulses of approximately 1000 V can be generated with the ignition circuit described, sufficient for igniting a high-pressure sodium discharge lamp quickly and reliably.

I claim:

1. A high-pressure discharge lamp having a sealed outer envelope, a discharge vessel mounted within said outer envelope, said discharge vessel including electrodes between which a discharge extends in the operational condition of the lamp, current-supply conductors connected to each of said discharge electrodes, and an ignition circuit including a fuse within the outer envelope, characterized in that:

the fuse is placed in an oxidizing atmosphere capsule within the outer envelope.

2. A lamp as claimed in claim 1, characterized in that the fuse is mounted in a gastight capsule within the outer envelope.

3. A lamp as claimed in claim 2, characterized in that the oxidizing atmosphere is formed from a mixture of $N_2$ and $O_2$.

4. A lamp as claimed in claim 3, characterized in that the ignition circuit also comprises a voltage-dependent capacitor which is also mounted in the gastight capsule.

5. A lamp as claimed in claim 4, characterized in that the fuse and the voltage-dependent capacitor are integrated into a single component.

6. A lamp as claimed in claim 2, characterized in that the ignition circuit also comprises a voltage-dependent capacitor which is also mounted in the gastight capsule.

7. A lamp as claimed in claim 6, characterized in that the fuse and the voltage-dependent capacitor are integrated into a single component.

8. A lamp as claimed in claim 1, characterized in that the oxidizing atmosphere is formed from a mixture of $N_2$ and $O_2$.

9. A lamp as claimed in claim 8, characterized in that the ignition circuit also comprises a voltage-dependent capacitor which is also mounted in the gastight capsule.

10. A lamp as claimed in claim 9, characterized in that the fuse and the voltage-dependent capacitor are integrated into a single component.

11. A high pressure discharge lamp, comprising:

a) an outer envelope;

b) a discharge vessel arranged within said outer envelope and energizeable for emitting light, c) a fuse arranged within the outer envelope and electrically connected to the discharge vessel; and d) A capsule means within said outer envelope for maintaining an oxidizing atmosphere around said fuse and a non-oxidizing atmosphere about said discharge vessel.

12. A high pressure discharge lamp according to claim 11, wherein said means comprises a glass wall partitioning said fuse and oxidizing atmosphere from said discharge vessel.

13. A high pressure discharge lamp according to claim 12, wherein said means comprises a gas tight capsule about said fuse.

14. A high pressure discharge lamp according to claim 12, further comprising an ignition circuit within said outer envelope, said ignition circuit comprising said fuse and a voltage-dependent capacitor mounted with said fuse within said gas-tight capsule.

15. A high pressure discharge lamp as claimed in claim 14, characterized in that the fuse and the voltage-dependent capacitor are integrated into a single component.

16. A high pressure discharge lamp as claimed in claim 15, characterized in that the oxidizing atmosphere is formed from a mixture of $N_2$ and $O_2$.

17. A high pressure discharge lamp according to claim 11, wherein said means comprises a gas tight capsule about said fuse.

18. A high pressure discharge lamp as claimed in claim 11, characterized in that the oxidizing atmosphere is formed from a mixture of $N_2$ and $O_2$.

19. A high pressure discharge lamp according to claim 11, wherein said fuse comprises a length of metal wire.

* * * * *